United States Patent [19]

Jagodzinski et al.

[11] Patent Number: 5,070,898

[45] Date of Patent: Dec. 10, 1991

[54] METERING VALVE

[75] Inventors: Robert Jagodzinski, Cheektowaga; Bruce R. Goff, Akron, both of N.Y.

[73] Assignee: HSC Controls Inc., Buffalo, N.Y.

[21] Appl. No.: 653,708

[22] Filed: Feb. 11, 1991

[51] Int. Cl.[5] ..... G03D 16/20

[52] U.S. Cl. ..... 137/82; 137/625.3; 137/83

[58] Field of Search ..... 137/83, 82, 625.64, 137/625.62, 625.3; 251/281

[56] References Cited

U.S. PATENT DOCUMENTS

| | | | |
|---|---|---|---|
| 3,221,760 | 12/1965 | Buchanan | 137/625.62 X |
| 3,489,179 | 1/1970 | McNeil | 137/625.62 |
| 3,712,339 | 1/1973 | Bartholomaus | 137/625.64 X |
| 3,746,044 | 7/1973 | Velicer | 137/83 X |
| 3,833,017 | 9/1974 | Gordon | 137/83 X |
| 4,362,182 | 12/1982 | Sjolund | 137/82 X |

*Primary Examiner*—Alan Cohan

*Attorney, Agent, or Firm*—Joseph P. Gastel

[57] ABSTRACT

A valve including a valve body, a torque motor mounted on the valve body and including an armature, a metering arm connected to the armature and extending into a first bore in the valve body, second and third coaxial bores in the valve body extending transversely to the first bore and being intersected by the metering arm, a pair of metering orifice members in the second and third bores with openings adjacent the metering arm, and fourth and fifth coaxial bores in the valve body having an axis which intersects both the metering arm and the axis of the second and third bores so as to permit viewing of the metering arm relative to the metering orifice members, a loose connection between the torque motor and the valve body to permit adjustment of the metering arm relative to the metering orifice members, and adjustment structure for permitting the axial and rotational orientation of the metering orifice members within the second and third bores.

22 Claims, 4 Drawing Sheets

Fig. 8.
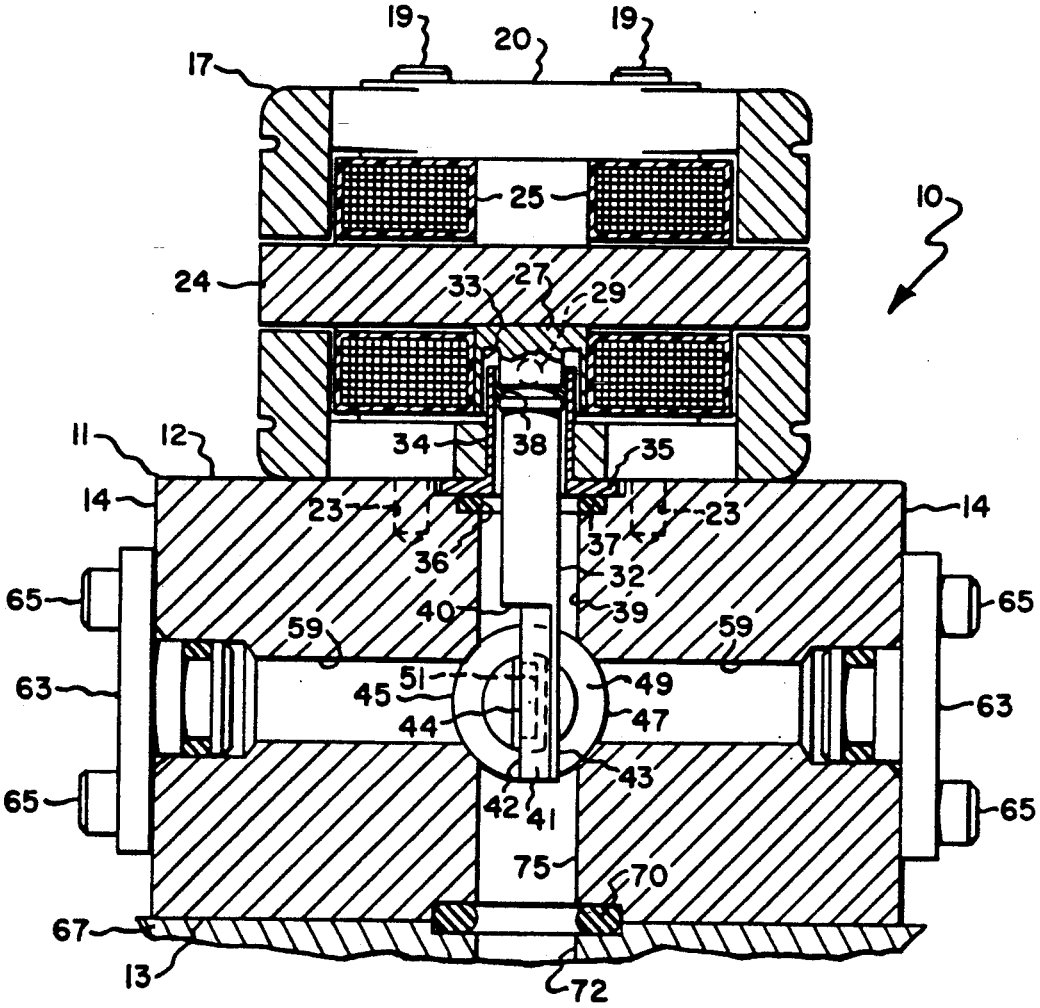
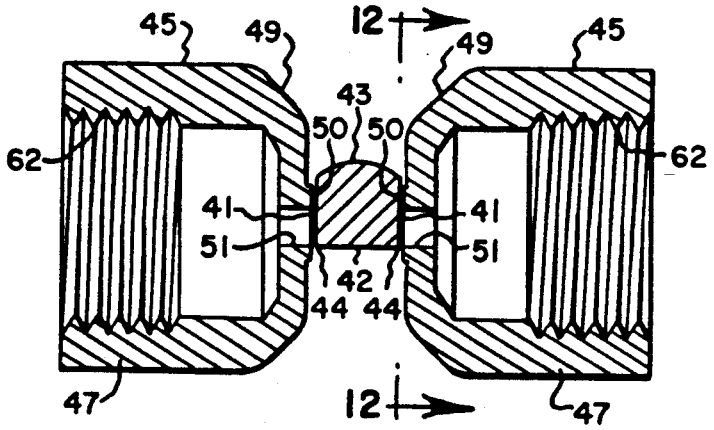
Fig. 11.
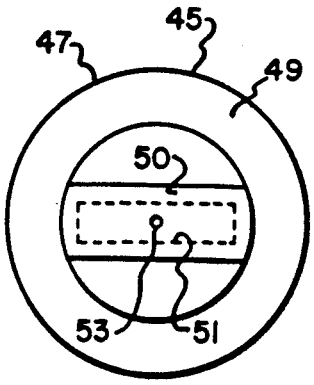
Fig. 12.

METERING VALVE

BACKGROUND OF THE INVENTION

The present invention relates to an improved torque motor operated metering valve.

By way of background, there is known a prior type of metering valve which is also known as a wet clevis valve. In the prior valve, fluid flow was through openings in an upstanding post having flat parallel faces, and a torque motor operated clevis member was movable relative to such openings to control flow. This prior type of valve had certain disadvantages, namely, that the clearances between the various parts had to be established during machining because the parts were not adjustable relative to each other after the valve was assembled. It is with an improvement over the foregoing type of valve that the present invention is concerned.

SUMMARY OF THE INVENTION

It is one object of the present invention to provide an improved metering valve which is fabricated in such a manner that there is extremely small clearances between the operating parts, namely, the metering arm and the metering orifice members associated therewith.

Another object of the present invention is to provide an improved metering valve wherein, after the valve has been assembled, the metering arm can be adjusted relative to the metering orifice members, and the metering orifice members can be adjusted both relative to the metering arm and to each other in the block in which they are located.

A further object of the present invention is to provide an improved metering valve wherein the adjustments between the metering arm and the metering orifice members may be made visually while the parts are in operative position within the valve body. Other objects and attendant advantages of the present invention will readily be perceived hereafter.

The present invention relates to a valve comprising a valve body, a torque motor including a motor frame mounted on said valve body, an armature in said torque motor, means securing said armature to said motor frame for pivotal movement relative thereto, a fluid duct in said valve body, a plurality of opposed metering orifice members in said valve body in communication with said fluid duct, a metering arm having parallel planar faces on opposite sides thereof coupled to said armature and located in said fluid duct between said opposed metering orifice members with a clearance therebetween, and duct means in said valve body in communication with said metering orifice members for effecting simultaneous flow either into or out of each of said metering orifice members.

The present invention also relates to a valve comprising a valve body, a torque motor mounted on said valve body, an armature on said torque motor, a first bore in said valve body, a metering arm coupled to said armature and extending into said first bore, second and third opposed bores in said valve body extending transversely to said first bore, metering orifice members in said second and third bores, said metering arm being located between said metering orifice members in fluid metering relationship therewith, and bore means in said valve body extending transversely to said second and third bores and having a line of sight for permitting visual observation of said portion of said metering arm and the portions of said metering orifice members adjacent thereto.

The various aspects of the present invention will be more fully understood when the following portions of the specification are read in conjunction with the accompanying drawings wherein:

BRIEF DESCRIPTION OF THE DRAWINGS

FIG. 8 is a fragmentary cross sectional view taken substantially along line 8—8 of FIG. 1;

FIG. 11 is an enlarged cross sectional view taken substantially along line 11—11 of FIG. 6 with the valve body omitted showing the relationship between the metering arm and the valve metering orifice members;

FIG. 12 is a view taken substantially in the direction of arrows 12—12 of FIG. 11.

DESCRIPTION OF THE PREFERRED EMBODIMENTS

Figure 1:
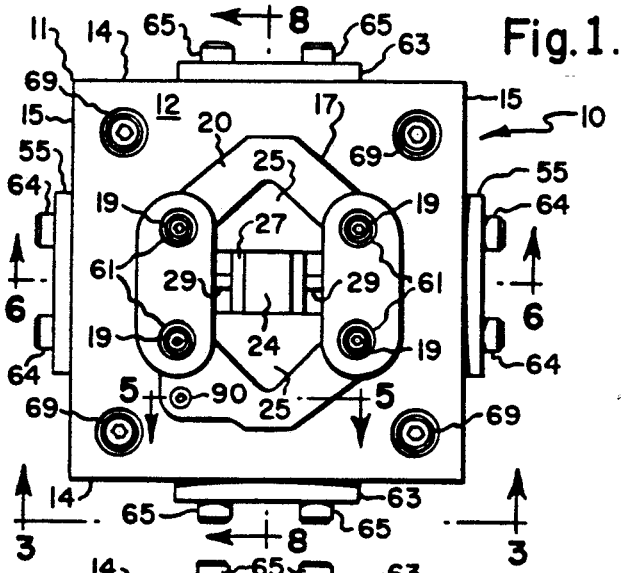
FIG. 1 is a top plan view of the valve of the present invention.
Figure 2:
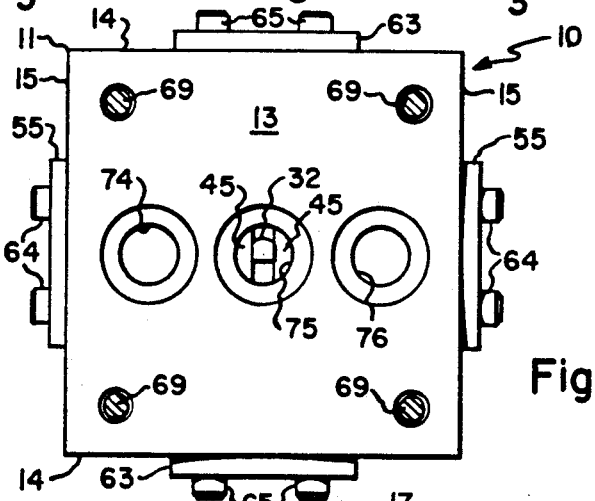
FIG. 2 is a bottom plan view of the valve of FIG. 1.

The improved valve 10 of the present invention, which is known as a metering valve or an inverse dry clevis valve, includes a steel valve body 11 having an upper surface 12, a lower surface 13, a first pair of opposite side surfaces 14 and a second pair of opposite side surfaces 15.

Figure 9:
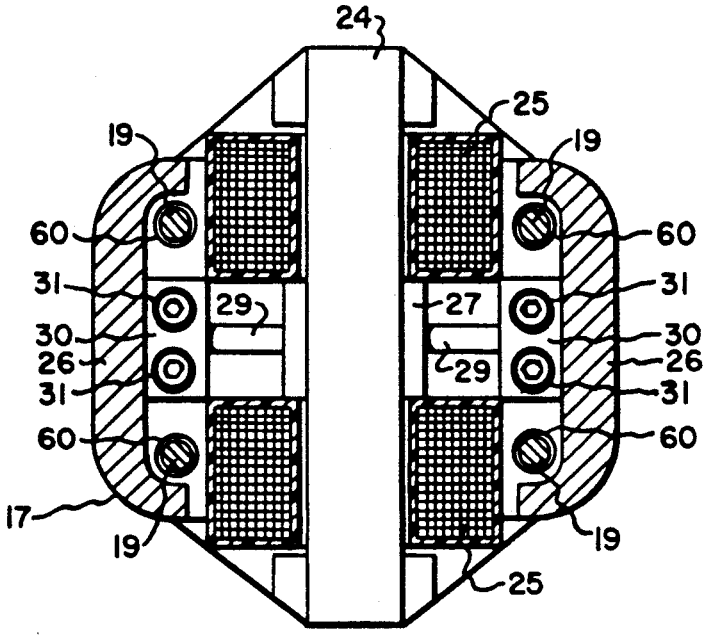
FIG. 9 is a cross sectional view taken substantially along line 9—9 of FIG. 3 and showing the mounting structure for the armature.

A torque motor 17 is mounted on upper surface 12 of valve body 11 by means of a plurality of screws 19 which extend through upper frame member 20 and lower frame member 21 and are received in tapped bores 23 in valve body 11. Magnets 26 are clamped between frame members 20 and 21 by the tightening of screws 19. An armature 24 is encircled by coils 25 which are suitably affixed to frame member 17. Armature 24 is rigidly affixed, as by brazing, to block 27 (FIG. 6) having torsion bars 29 (FIG. 9) extending from opposite sides thereof and fixed to blocks 30 which are rigidly secured to lower frame member 21 by screws 31 which extend into tapped bores (not shown) in lower frame member 21.

A metering arm 32 extends downwardly from bore 33 (FIG. 6) within block 27, and a sleeve 34 which is fixedly secured to lower frame member 21 has its upper portion extending upwardly into bore 33. Sleeve 34 is of larger diameter than the upper portion of metering arm 32 which it encompasses so as to permit movement of the latter. An annular flange 35 is formed at the lower end of sleeve 34 and when the torque motor is assembled onto valve body 11, flange 35 bears on O-ring 37 which is suitably housed within counterbore 36 within valve body 11. O-ring 37 provides a seal to prevent any fluid in duct 39 in which metering arm 32 is located from passing out of the upper end of duct 39. The upper end of metering arm 32 is cylindrical to shoulder 40. An O-ring 38 fits in an annular groove in metering arm 32, and it provides a seal with sleeve 34. Below shoulder 40, metering arm 32 is formed, as shown in FIG. 11, with two parallel flat faces 41, a flat face 42 which extends perpendicularly to each flat face 41 and a curved surface 43 which is an extension of the cylindrical surface of the upper portion of metering arm 32. The intersection of planes 41 with plane 42 provide metering edges 44.

Figure 10:
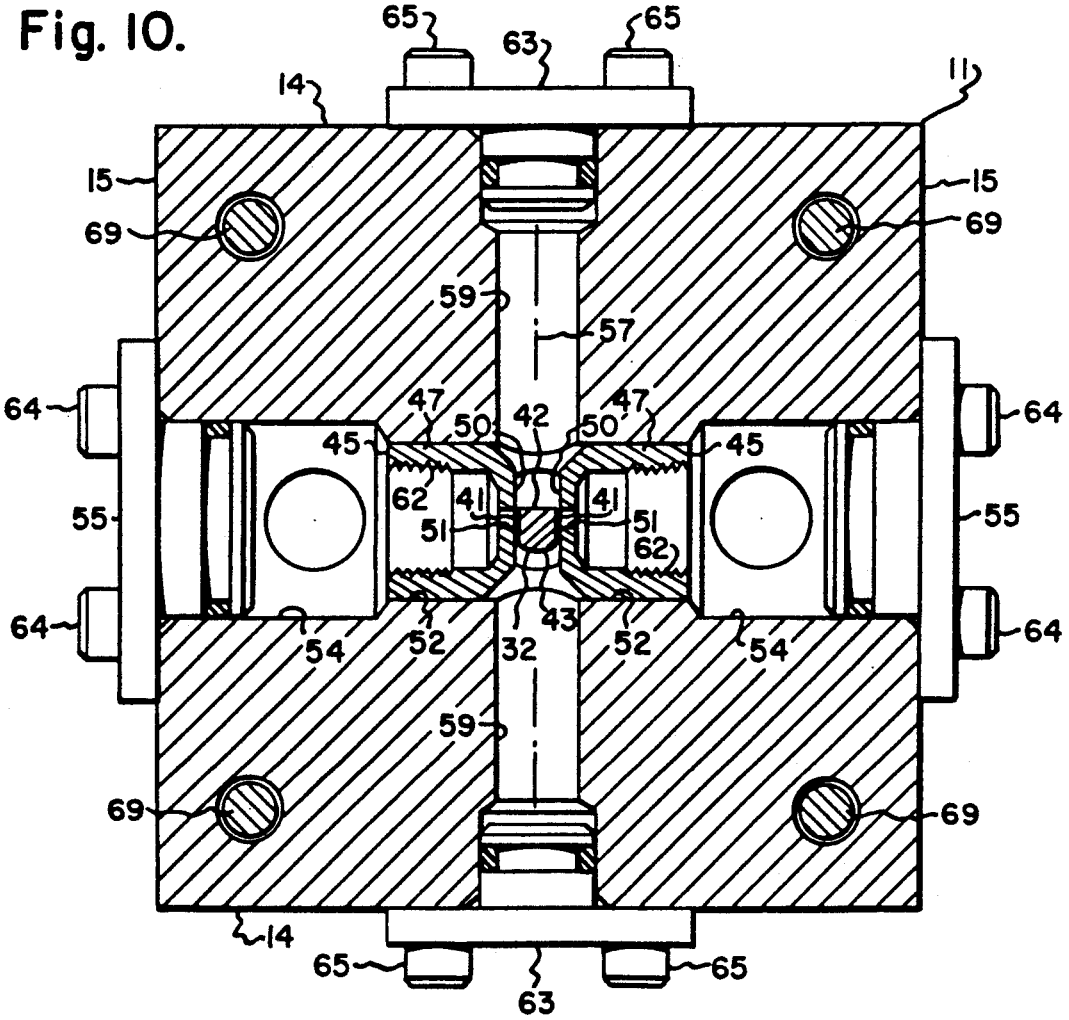
FIG. 10 is a cross sectional view taken substantially along line 10—10 of FIG. 3 and showing the relationship of the cross bores to the metering orifice members and the metering arm.

The metering arm 32 bears an unique relationship to the metering orifice members 45 which are associated therewith which in turn bear an unique relationship to the valve body 11. Each metering orifice member 45 includes a cylindrical body portion 47 (FIG. 11) which is chamfered to a frustoconical configuration 49 at its end and which has a flat 50 thereon through which a rectangular opening 51 passes. The rectangular openings 51 are produced by wire electrical discharge machining (hereafter referred to as EDM) after the metering orifice members 45 are inserted into valve ducts 52 with a press-fit. More specifically, originally the apertures in metering orifice members 45 were small and circular as depicted by numeral 53 in FIG. 12. In order to EDM the the rectangular openings 51, a wire is passed through the small holes 53 and through stepped bores 54 (FIG. 10) in valve body 11. At this time end plugs 55 are not located in valve body 11. Thereafter, the EDM wire and the valve body 11 are moved relative to each other to generate the rectangular openings 51. Prior to the EDM machining, the metering orifice members 45 are located as close as possible to their desired final positions relative to the centerline 57 of cross bores 59, the axes of which extend perpendicularly to the axes of bores 54.

After the EDM machining has been completed, the torque motor with its assembled metering arm 32 is mounted onto valve body 11, and screws 19 are placed in position but not tightened. It is to be noted that the holes 60 in lower frame member 21 (FIG. 9) and the holes 61 in upper frame member 20 through which screws 19 pass are slightly oversize relative to screws 19 so that the torque motor frame can be shifted in the following directions in FIG. 1, namely, up and down, side to side or rotated. By such manipulation the faces 41 (FIG. 11) of the metering arm 32 can be adjusted so that they are perfectly parallel to flat faces 50 of metering orifice members 45 and equally spaced therefrom, so that as metering arm 32 moves relative to metering orifice members 45, there will be equal flow out of or into each of these metering orifice members. At this point it is to be again noted that the valve is to operate by having fluid pass out of each metering orifice member 45 simultaneously or pass into each metering orifice member simultaneously. It is not intended that fluid pass out of one metering orifice member and into the other one. If it should be found that further axial or radial adjustments of metering orifice members 45 are desired to obtain exact alignment of openings 51 or exact spacing between planar sides 41 and planar metering orifice member ends 50, metering orifice members 45 can be moved axially within bores 52 in which they have been press-fitted. In this respect, the insides of metering orifice member bodies 47 are tapped at 62, and a threaded tool can be inserted into the metering orifice members when plugs 55 are removed from bores 54 so that metering orifice members 45 can be moved axially in bores 52 or rotated therein.

The metering orifice members 45 and the metering arm 32 can be adjusted visually by sighting through cross bores 59 when plugs 63 are are not located in bores 59 because cross bores 59 provide a line of sight which permit visual observation of metering arm 32 and the adjacent ends of metering orifice members 47. After the metering orifice members 45 and the metering arm 32 have been properly aligned, plugs 55 and 63 are inserted into their associated bores and tightened down with screws 64 and 65, respectively. O-rings (not numbered) are associated with plugs 55 and 63 to seal the bores into which the plugs are placed.

The capability for adjusting of the metering arm and metering orifice members in the above-described manner obviates the criticality of requiring exact machining of the dimensions of the parts prior to assembly, although the faces 50 of the metering orifice members and the faces 41 of the metering arm should be parallel. The metering orifice members 45 should be adjusted relative to the metering arm so that the clearances therebetween do not exceed a desired value, namely, about one thousandth of an inch but may be more or less, as required for any particular application, and such clearances can be closely controlled. These one thousandth of an inch clearances are approximately equal to the clearances generally obtained between a spool and the bore of a spool valve in which it moves.

Figure 6:
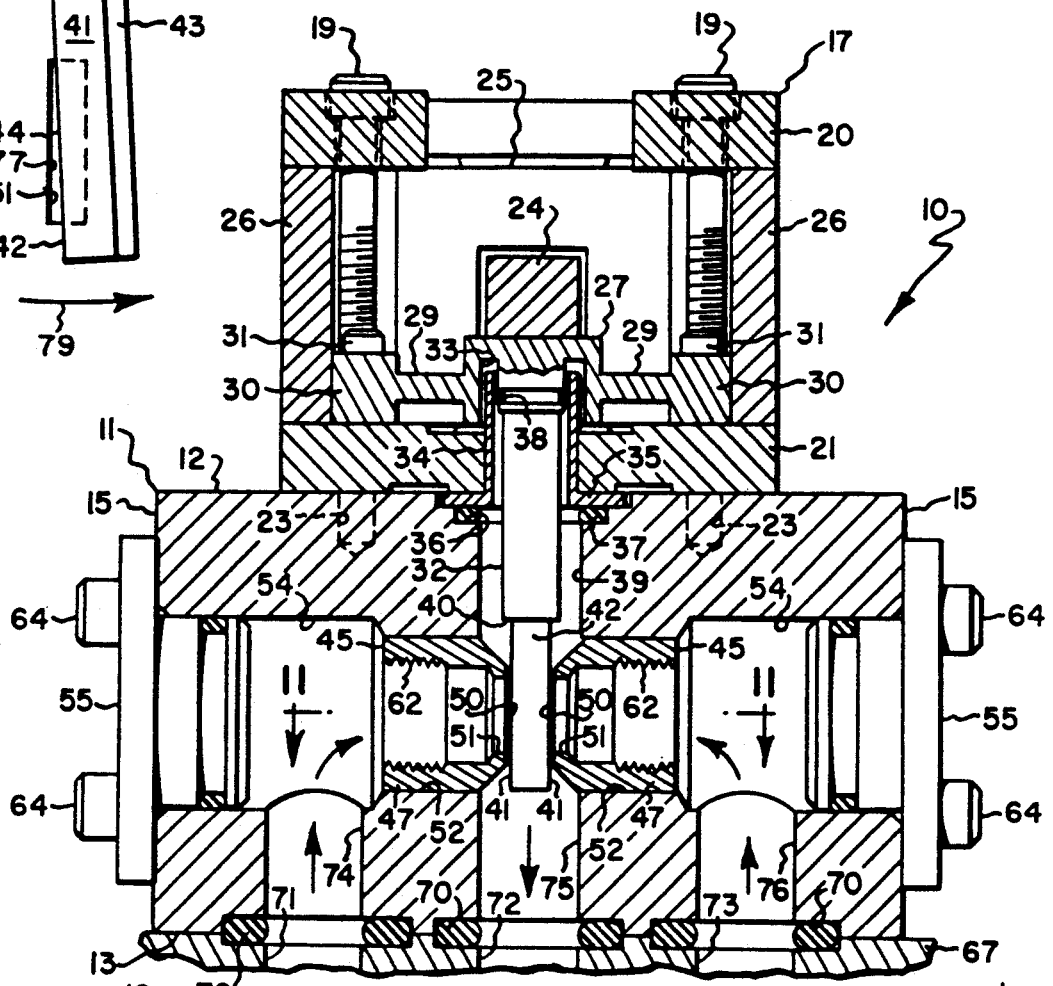
FIG. 6 is a fragmentary enlarged cross sectional view taken substantially along line 6—6 of FIG. 1 and showing an embodiment which has two fluid inlets and wherein the fluid flows out through each of the metering orifice members and into a common outlet duct.

The valve body 11 is secured to an associated device 67 (FIGS. 6 and 8) by means of a plurality of screws 69 which extend through the valve body. O-rings 70 (FIG. 6) provide suitable seals between the ducts 71, 72 and 73 in the associated device and ducts 74, 75 and 76, respectively, in valve body 11 (FIGS. 1 and 6). The fluid flow through the valve 10 is depicted by the arrows in FIG. 6. This fluid can be aircraft fuel which is delivered to a fuel nozzle, or it can be any other suitable types of liquid. More specifically, preferably the flow into valve body 11 is through valve ducts 74 and 76, through ducts 54 and through metering orifice members 45. The outflow is through duct 75 after the fluid passing through metering orifice members 45 has been metered by metering arm 32. Alternatively, the inflow can be through duct 75 and out through ducts 74 and 76. However, it is to be noted that the flow is either into metering orifice members 45 simultaneously or out of metering orifice members 45 simultaneously, but not from one metering orifice member 45 to the other metering orifice member 45.

Figure 13:
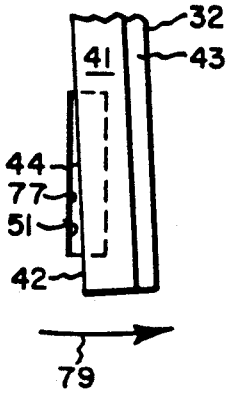
FIG. 13 is an enlarged schematic view showing the manner in which the metering arm moves relative to the metering orifice members.

In the metering position, the metering arm 32 occupies the position shown in FIG. 11 wherein the metering edges 44 are coincident with the edges 77 (FIG. 13) of rectangular metering orifice member openings 51. In this position, which is known as the null or zero position, there is no flow, and because openings 51 will be opened with the slightest counterclockwise movement of metering arm 32 in FIG. 13, there is a conservation of stroke, that is very little movement of armature 24 is required. However, when the torque motor 17 is energized, the metering arm 32 will move in the direction of arrow 79 (FIG. 13) to uncover metering orifice member openings 51 in the depicted manner, with the amount of opening being dependent on the amount of energization of the torque motor.

Figure 7:
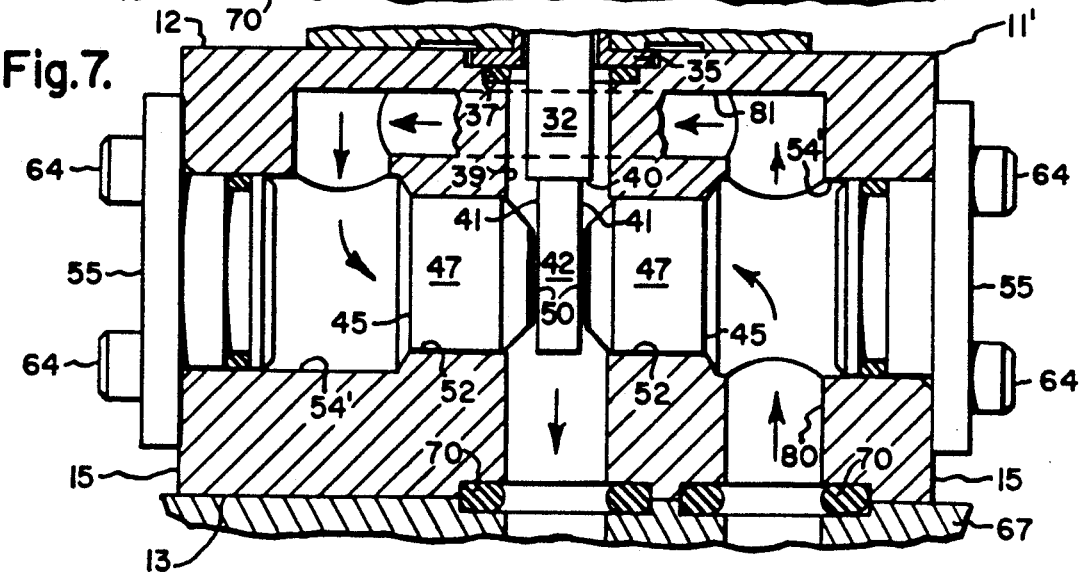
FIG. 7 is a fragmentary cross sectional view similar to FIG. 6 but showing a modification of the valve having only one fluid inlet.

Under certain circumstances it is desired that the pressure of the fluid applied to both metering orifice members 45 be as close as possible. Accordingly, the embodiment of FIG. 7 can be utilized wherein there is only a single fluid inlet duct 80 and there is a cross duct 81 in valve body 11' so that fluid entering duct 80 will pass through duct 54', which is analogous to duct 54 of FIG. 6, and then pass into duct 81 and then pass into the other duct 54' at the left of FIG. 7 from which it will pass through the metering orifice member 45 associated with the latter. By the foregoing construction, the pressure at both metering orifice members 45 is identical.

Figure 5:
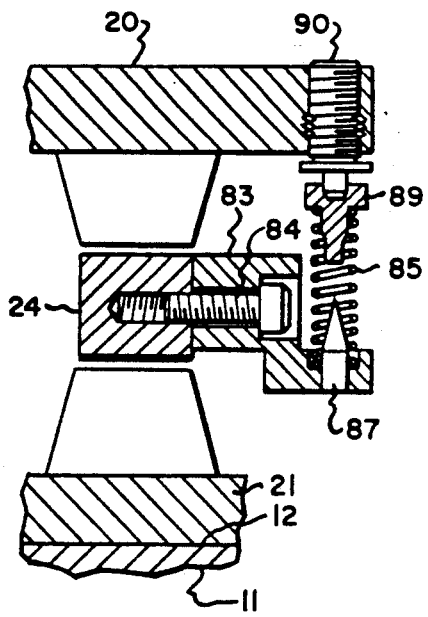
FIG. 5 is a fragmentary enlarged cross sectional view taken substantially along line 5—5 of FIG. 1 and showing the armature biasing structure.
Figure 3:
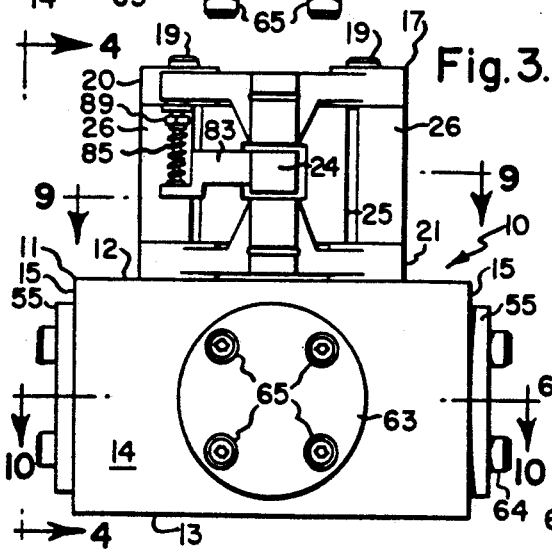
FIG. 3 is a side elevational view taken substantially in the direction of arrows 3—3 of FIG. 1.
Figure 4:
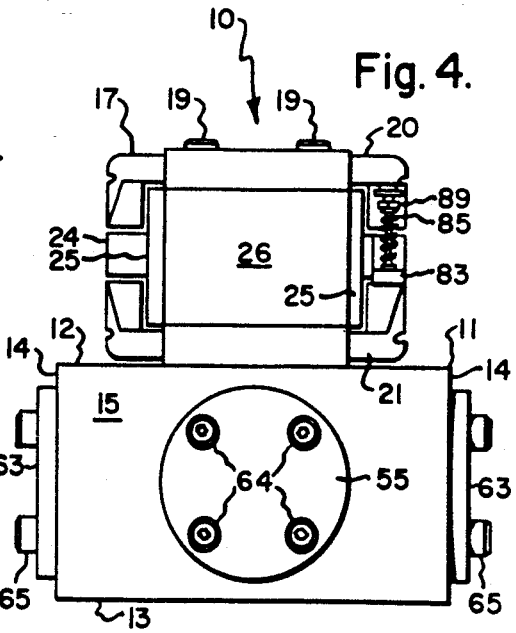
FIG. 4 is a side elevational view taken substantially in the direction of arrows 4—4 of FIG. 3.

The armature has structure associated therewith in FIG. 5 for the purpose of biasing it to a closed position when the torque motor 17 is not actuated. In this respect, a member 83 is attached to armature 24 by screw 84. The lower end of a spring 85 encircles a pin 87 on armature 24, and the upper end of spring 85 encircles member 89. A set screw adjustment 90 which engages member 89 is provided in upper frame member 20. Thus, by tightening or loosening screw 90 to vary the compression of springs 85, the biasing force on armature 24 can be varied.

While preferred embodiments of the present invention have been disclosed, it will be appreciated that it is not limited thereto but may be otherwise embodied within the scope of the following claims.

What is claimed is:

1. A valve comprising a valve body, a torque motor including a motor frame mounted on said valve body, first fluid duct means in said valve body, a plurality of opposed metering orifice members in said valve body extending substantially along a common axis and in communication with said first fluid duct means, an armature in said torque motor, a metering arm having faces on opposite sides thereof coupled to said armature and located in said first fluid duct means between said opposed metering orifice members with clearances therebetween, means securing said armature to said torque motor for pivotal movement relative thereto and for movement in a direction substantially perpendicular to said common axis to thereby simultaneously more expose each of said plurality of opposed metering orifice members or simultaneously more constrict each of said plurality of opposed metering orifice members, and second fluid duct means in said valve body in communication with said metering orifice members for effecting simultaneous flow either into or out of each of said metering orifice members and into and out of said first fluid duct means, respectively.

2. A valve as set forth in claim 1 wherein each of said metering orifice members comprises a body which is movably fitted into a bore in said valve body, and means in each of said metering orifice members for effecting axial movement thereof for adjusting the axial position of said metering orifice members relative to said metering arm.

3. A valve as set forth in claim 1 including means for permitting rotational adjustment of said motor frame on said valve body for adjusting the rotational position of said metering arm relative to said metering orifice members.

4. A valve as set forth in claim 3 wherein each of said metering orifice members comprises a body which is movably fitted into a bore in said valve body, and means in each of said metering orifice members for effecting axial movement thereof for adjusting the axial position of said metering orifice members relative to said metering arm.

5. A valve comprising a valve body, a torque motor mounted on said valve body, an armature on said torque motor, a first bore in said valve body, a metering arm coupled to said armature and extending into said first bore, second and third opposed bores in said valve body extending transversely to said first bore, metering orifice members in said second and third bores, said metering arm being located between said metering orifice members in fluid metering relationship therewith, and bore means in said valve body extending transversely to said second and third bores and having a line of sight for permitting visual observation of said metering arm and the portions of said metering orifice members adjacent thereto.

6. A valve as set forth in claim 5 including means for adjusting the position of said metering arm between said metering orifice members.

7. A valve as set forth in claim 5 wherein said bore means comprise fourth and fifth bores on opposite sides of said metering arm.

8. A valve as set forth in claim 5 wherein said metering orifice members include planar outer faces with quadrangular openings therein having first edges, and wherein said metering arm has second edges which are adjacent to said first edges during a fluid metering action.

9. A valve as set forth in claim 8 wherein said metering arm includes planar sides on opposite sides thereof adjacent said planar outer faces of said metering orifice members.

10. A valve as set forth in claim 9 wherein said metering arm includes an additional planar side which extends substantially perpendicularly to said planar sides to define said second edges at the intersections therebetween.

11. A valve as set forth in claim 5 including adjusting means for moving said metering orifice members in said second and third bores.

12. A valve as set forth in claim 11 including metering arm adjusting means for adjusting the position of said metering arm between said metering orifice members.

13. A valve as set forth in claim 12 wherein said metering arm adjusting means includes means for adjusting the rotational position of said metering arm.

14. A valve comprising a valve body, a torque motor including a motor frame mounted on said valve body, an armature in said torque motor, means securing said armature to said motor frame for pivotal movement relative thereto, a fluid duct in said valve body, a plurality of opposed metering orifice members in said valve body in communication with said fluid duct, a metering arm having parallel planar faces on opposite sides thereof coupled to said armature and located in said fluid duct between said opposed metering orifice members with a clearance therebetween, duct means in said valve body in communication with said metering orifice members for effecting simultaneous flow either into or out of each of said metering orifice members, said metering orifice members having quadrangular openings at the ends thereof proximate said metering arm, and said parallel faces on said metering arm being intersected by a second planar face which extends transversely thereto so as to form a metering edge with each of said parallel faces, and each of said metering edges being substantially aligned with an edge of each of said quadrangular openings when said metering arm obstructs said quadrangular openings.

15. A valve as set forth in claim 14 wherein each of said metering orifice members comprises a body which is movably fitted into a bore in said valve body, and means in each of said metering orifice members for effecting axial movement thereof for adjusting the axial position of said metering orifice members relative to said metering arm.

16. A valve comprising a valve body, a torque motor including a motor frame mounted on said valve body, an armature in said torque motor, means securing said armature to said motor frame for pivotal movement relative thereto, a fluid duct in said valve body, a plurality of opposed metering orifice members in said valve body in communication with said fluid duct, a metering arm having parallel planar faces on opposite sides thereof coupled to said armature and located in said fluid duct between said opposed metering orifice members with a clearance therebetween, duct means in said valve body in communication with said metering orifice members for effecting simultaneous flow either into or out of each of said metering orifice members, means for permitting rotational adjustment of said motor frame on said valve body for adjusting the rotational position of said metering arm relative to said metering orifice members, each of said metering orifice members comprising a body which is movably fitted into a bore in said valve body, means in each of said metering orifice members for effecting axial movement thereof for adjusting the axial position of said metering orifice members relative to said metering arm, said metering orifice members having quadrangular openings at the ends thereof proximate said metering arm, and said parallel faces on said metering arm being intersected by a second planar face which extends transversely thereto so as to form a metering edge with each of said parallel faces, and each of said metering edges being substantially aligned with an edge of each of said quadrangular openings when said metering arm obstructs said quadrangular openings.

17. A valve comprising a valve body, a torque motor including a motor frame mounted on said valve body, an armature in said torque motor, means securing said armature to said motor frame for pivotal movement relative thereto, a fluid duct in said valve body, a plurality of opposed metering orifice members in said valve body in communication with said fluid duct, a metering arm having parallel planar faces on opposite sides thereof coupled to said armature and located in said fluid duct between said opposed metering orifice members with a clearance therebetween, duct means in said valve body in communication with said metering orifice members for effecting simultaneous flow either into or out of each of said metering orifice members, means for permitting rotational adjustment of said motor frame on said valve body for adjusting the rotational position of said metering arm relative to said metering orifice members, said metering orifice members having quadrangular openings at the ends thereof proximate said metering arm, and said parallel faces on said metering arm being intersected by a second planar face which extends transversely thereto so as to form a metering edge with each of said parallel faces, and each of said metering edges being substantially aligned with an edge of each of said quadrangular openings when said metering arm obstructs said quadrangular openings.

18. A valve comprising a valve body, a torque motor including a motor frame mounted on said valve body, an armature in said torque motor, means securing said armature to said motor frame for pivotal movement relative thereto, a fluid duct in said valve body, a plurality of opposed metering orifice members in said valve body in communication with said fluid duct, a metering arm having parallel planar faces on opposite sides thereof coupled to said armature and located in said fluid duct between said opposed metering orifice members with a clearance therebetween, duct means in said valve body in communication with said metering orifice members for effecting simultaneous flow either into or out of each of said metering orifice members, each of said metering orifice members being located in second coaxial fluid ducts in said valve body on opposite sides of said fluid duct and in intersecting relationship thereto, and cross bore means in said valve body extending transversely to said second coaxial fluid ducts and intersecting said fluid duct for permitting visual observation of the adjustment of said metering arm relative to said metering orifice members.

19. A valve as set forth in claim 18 wherein said metering orifice members terminate at substantially flat faces immediately adjacent said parallel faces of said metering arm.

20. A valve as set forth in claim 18 wherein said second ducts extend outwardly to the outer sides of said valve body to permit viewing of said metering arm for permitting visual adjustment of either said metering arm or said metering orifice members relative to each other or relative to said metering arm.

21. A valve as set forth in claim 19 including means for permitting rotational adjustment of said motor frame on said valve body for adjusting the rotational position of said metering arm relative to said metering orifice members.

22. A valve as set forth in claim 21 wherein each of said metering orifice members comprises a body which is movably fitted into a bore in said valve body, and means in each of said metering orifice members for effecting axial movement thereof for adjusting the axial position of said metering orifice members relative to said metering arm.

* * * * *

UNITED STATES PATENT AND TRADEMARK OFFICE

CERTIFICATE OF CORRECTION

PATENT NO. : 5,070,898

DATED : December 10, 1991

INVENTOR(S) : Robert Jagodzinski et al

It is certified that error appears in the above-identified patent and that said Letters Patent is hereby corrected as shown below:

Column 4, line 49, change "types" to --type--.

Column 5, line 30, change "springs" to --spring--.

Column 8, line 47 (claim 21), change "19" to --18--.

Signed and Sealed this

Thirtieth Day of March, 1993

*Attest:*

STEPHEN G. KUNIN

*Attesting Officer*

*Acting Commissioner of Patents and Trademarks*